US011313566B2

(12) United States Patent
Moro et al.

(10) Patent No.: US 11,313,566 B2
(45) Date of Patent: Apr. 26, 2022

(54) INDOOR UNIT OF AIR-CONDITIONING APPARATUS

(71) Applicant: Mitsubishi Electric Corporation, Tokyo (JP)

(72) Inventors: Koki Moro, Tokyo (JP); Norio Katsuma, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 137 days.

(21) Appl. No.: 16/959,256

(22) PCT Filed: Jan. 25, 2018

(86) PCT No.: PCT/JP2018/002261
§ 371 (c)(1),
(2) Date: Jun. 30, 2020

(87) PCT Pub. No.: WO2019/146036
PCT Pub. Date: Aug. 1, 2019

(65) Prior Publication Data
US 2020/0333020 A1 Oct. 22, 2020

(51) Int. Cl.
*F24F 13/08* (2006.01)
*F24F 1/0063* (2019.01)

(52) U.S. Cl.
CPC ..... *F24F 1/0063* (2019.02); *F24F 13/082* (2013.01)

(58) Field of Classification Search
CPC ..... F24F 13/06; F24F 13/08; F24F 13/082; F24F 13/10; F24F 13/14; F24F 13/1413;
(Continued)

(56) References Cited

U.S. PATENT DOCUMENTS

2013/0167578 A1 7/2013 Ikeda et al.
2015/0093983 A1* 4/2015 Jeong ..... F24F 1/0047 454/248
2016/0290662 A1* 10/2016 Fujita ..... F24F 13/1426

FOREIGN PATENT DOCUMENTS

JP S61-104141 U 7/1986
JP H05-322201 A 12/1993
(Continued)

OTHER PUBLICATIONS

International Search Report of the International Searching Authority dated Mar. 27, 2018 for the corresponding International application No. PCT/JP2018/002261 (and English translation).

*Primary Examiner* — Vivek K Shirsat
*Assistant Examiner* — Michael James Giordano
(74) *Attorney, Agent, or Firm* — Posz Law Group, PLC

(57) ABSTRACT

An indoor unit of an air-conditioning apparatus includes an air outlet; and a blowout flow passage connected to the air outlet and guides air subjected to heat exchange at a heat exchanger to the air outlet. In a cross section perpendicular to an air flow direction in the blowout flow passage, the passage has a first end and a second end in a longitudinal direction. The blowout flow passage is divided into first regions, a second region, and third regions. The first regions include the first end and the second end. The second region includes a center position in the longitudinal direction of the passage. The third regions are between the first regions and the second region in the longitudinal direction.

3 Claims, 4 Drawing Sheets

(58) Field of Classification Search
CPC .. F24F 13/15; F24F 13/16; F24F 13/20; F24F 2013/0616; F24F 1/011; F24F 1/0047
See application file for complete search history.

(56) References Cited

FOREIGN PATENT DOCUMENTS

| | | | | | |
|---|---|---|---|---|---|
| JP | 2001-304609 | A | | 10/2001 | |
| JP | 2012-078031 | A | | 4/2012 | |
| WO | 2011/064999 | A1 | | 6/2011 | |
| WO | WO-2015155855 | A1 | * | 10/2015 | ..... F24F 13/20 |

* cited by examiner

INDOOR UNIT OF AIR-CONDITIONING APPARATUS

CROSS REFERENCE TO RELATED APPLICATION

This application is a U.S. national stage application of PCT/JP2018/002261 filed on Jan. 25, 2018, the contents of which are incorporated herein by reference.

TECHNICAL FIELD

The present disclosure relates to an indoor unit of an air-conditioning apparatus including a blowout flow passage having a substantially rectangular cross section.

BACKGROUND ART

An indoor unit of an air-conditioning apparatus includes an air outlet, and a blowout flow passage connected to the air outlet and configured to guide air subjected to heat exchange in a heat exchanger to the air outlet. A certain type of related-art indoor unit includes a blowout flow passage having a substantially rectangular cross section perpendicular to a flow direction of air in the blowout flow passage. Specifically, the certain type of existing indoor unit includes a substantially rectangular air outlet. In the blowout flow passage having the substantially rectangular cross section, an air flow speed tends to be low around ends in a longitudinal direction.

Thus, a proposed related-art indoor unit includes steps around opposite ends in a longitudinal direction of a blowout flow passage (see, for example, Patent Literature 1). Providing the steps around the opposite ends in the longitudinal direction of the blowout flow passage allows the blowout flow passage to have such widths as described below. To be more specific, a width around the opposite ends in the longitudinal direction of the blowout flow passage with the steps is smaller than a width of an area without the step. Patent Literature 1 discloses that a blowout flow passage configured in this manner increases an air flow speed around the ends in the longitudinal direction and increases an air flow speed around ends in the longitudinal direction of an air outlet, thereby providing uniform speed distribution of air blown from the air outlet. The width of the blowout flow passage is a length of the blowout flow passage in a direction perpendicular to the longitudinal direction in a cross section of the blowout flow passage perpendicular to a flow direction of air in the blowout flow passage.

CITATION LIST

Patent Literature

Patent Literature 1: Japanese Unexamined Patent Application Publication No. 5-322201

SUMMARY OF INVENTION

Technical Problem

As described above, in the indoor unit disclosed in Patent Literature 1, the blowout flow passage has a smaller width around the ends in the longitudinal direction than in the other place. Thus, in the indoor unit disclosed in Patent Literature 1, as a speed of air blown from the air outlet is increased, a rate of increase in the air flow speed around the ends in the longitudinal direction of the blowout flow passage becomes higher than a rate of increase in the air flow speed in the area of the blowout flow passage without the step. In other words, as the speed of air blown from the air outlet is increased, the rate of increase in the air flow speed around the ends in the longitudinal direction of the blowout flow passage becomes higher than a rate of increase in an air flow speed at a center position in the longitudinal direction of the blowout flow passage. Thus, in the indoor unit disclosed in Patent Literature 1, even if the air flow speed of air blown from the air outlet is intended to be increased to above a certain speed, only the air flow speed around the ends in the longitudinal direction of the air outlet is increased, and the air flow speed at the center position in the longitudinal direction of the air outlet is not largely increased. Therefore, the indoor unit disclosed in Patent Literature 1 cannot increase a reach distance of air blown from the air outlet.

The present disclosure is applied to solve the above problem, and relates to an indoor unit of an air-conditioning apparatus that can provide uniform speed distribution of air blown from an air outlet and increase a reach distance of air blown from the air outlet.

Solution to Problem

An indoor unit of an air-conditioning apparatus according to an embodiment of the present disclosure includes; an air outlet; and a blowout flow passage connected to the air outlet and configured to guide air subjected to heat exchange at a heat exchanger to the air outlet. In a cross section perpendicular to a flow direction of the air in the blowout flow passage, the blowout flow passage has a first end and a second end in a longitudinal direction. The blowout flow passage is divided into first regions, a second region, and third regions. The first region is a region including the first end and a region including the second end. The second region is a region including a center position in the longitudinal direction of the blowout flow passage. The third regions are regions between the first regions and the second region in the longitudinal direction. When a length of the blowout flow passage in a direction perpendicular to the longitudinal direction in the cross section is defined as a width, a width of each of the first regions is defined as a first width, a width of the second region is defined as a second width, and a width of each of the third regions is defined as a third width, the second width is larger than the first width and smaller than the third width at least in a partial area of the blowout flow passage.

Advantageous Effects of Invention

In the indoor unit of an air-conditioning apparatus according to an embodiment of the present disclosure, the first width of the first region is smaller than the second width of the second region and the third width of the third region. Thus, the indoor unit of an air-conditioning apparatus according to the embodiment of the present disclosure can increase an air flow speed around ends in the longitudinal direction of the air outlet, thereby providing uniform speed distribution of air blown from the air outlet as before. Further, in the indoor unit of an air-conditioning apparatus according to the embodiment of the present disclosure, the second width of the second region is smaller than the third width of the third region. Thus, the indoor unit of an air-conditioning apparatus according to the embodiment of the present disclosure can increase an air flow speed at the second region as compared with the related-art indoor unit that provides uniform speed distribution of air blown from an air outlet, thereby increasing an air flow speed at the center position in the longitudinal direction of the air outlet. By increasing the air flow speed at the center position in the longitudinal direction of the air outlet, a flow of air blown from the air outlet through the third region is caught by a flow of air blown from the center position in the longitudinal direction of the air outlet and increased in speed. Thus, the indoor unit of an air-conditioning apparatus according to the embodiment of the present disclosure can increase a reach of air blown from the air outlet as compared with the existing indoor unit that provides uniform speed distribution of air blown from an air outlet.

DESCRIPTION OF EMBODIMENTS

Figure 1:
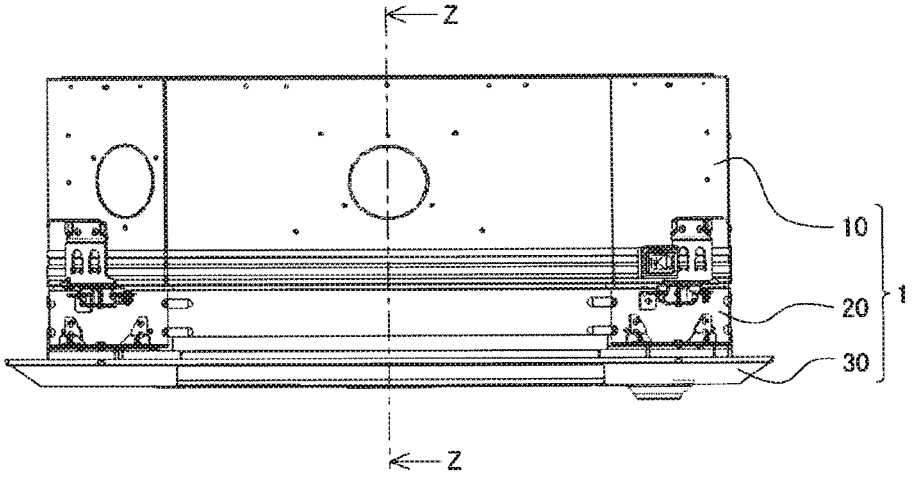
FIG. 1 is a side view of an indoor unit of an air-conditioning apparatus according to Embodiment 1 of the present disclosure.

Embodiments of an indoor unit of an air-conditioning apparatus according to the present disclosure will be described below with reference to the drawings. In the drawings, the same or corresponding components are denoted by the same reference signs. Configurations disclosed in the embodiments below are merely illustrative. The indoor unit of an air-conditioning apparatus according to the present disclosure is not limited to the configurations disclosed in the embodiments below. In the drawings, sizes of components may differ from sizes of actual components of the indoor unit of an air-conditioning apparatus according to the present disclosure.

Embodiment 1

Figure 2:
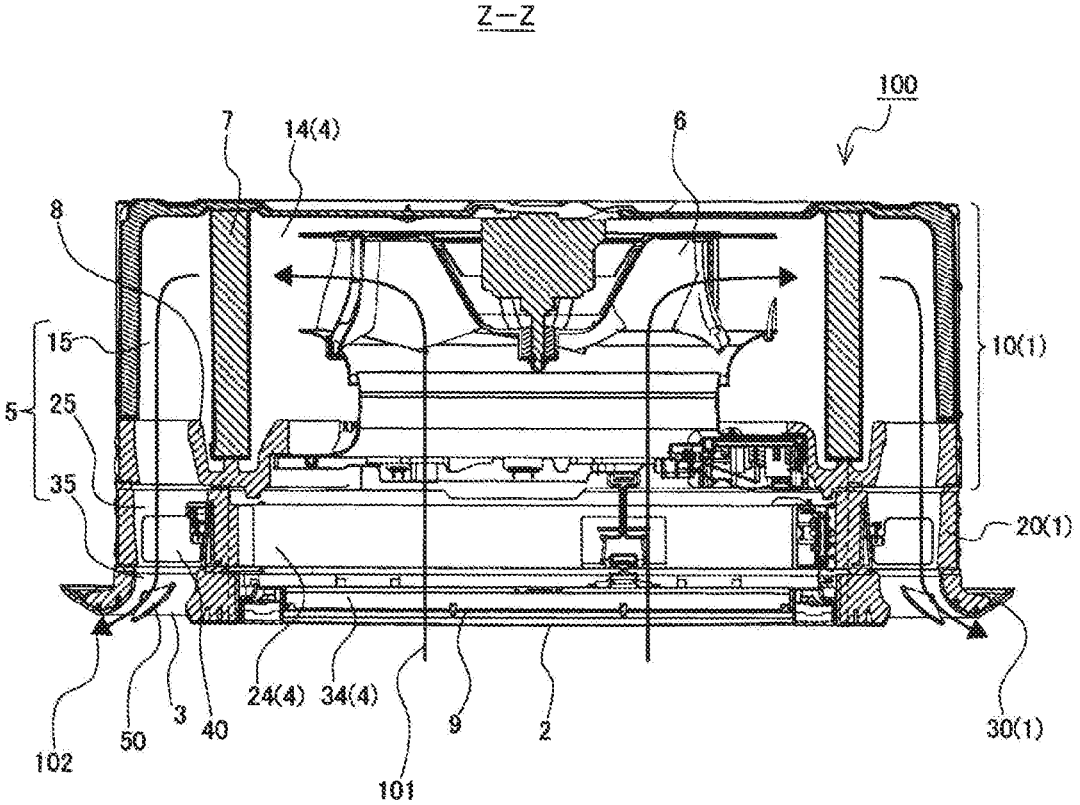
FIG. 2 is a sectional view taken along line Z-Z in FIG. 1.

FIG. 1 is a side view of an indoor unit of an air-conditioning apparatus according to Embodiment 1 of the present disclosure. FIG. 2 is a sectional view taken along line Z-Z in FIG. 1.

An indoor unit 100 of an air-conditioning apparatus according to Embodiment 1 is concealed in or suspended from a ceiling located above an air-conditioned space such as a room. The indoor unit 100 includes a casing 1 having an air inlet 2 and air outlets 3 that are provided as openings formed in a lower surface portion of the casing 1. It should be noted that in Embodiment 1, four air outlets 3 are provided. The casing 1 is, for example, a hollow box having a substantially rectangular cuboid shape. The air inlet 2 is open, for example, in a substantially center portion of the lower surface portion of the casing 1. The four air outlets 3 are located so as to surround four sides of the air inlet 2. Each of the air outlets 3 is rectangular, and is provided such that sides in a longitudinal direction of each air outlet 3 extend along an associated one of sides of the lower surface portion of the casing 1. The air inlet 2 includes a filter 9.

In the casing 1, a fan 6 such as a turbo fan is provided so as to face the air inlet 2. The fan 6 suctions air in the air-conditioned space from the air inlet 2 into the casing 1, and blows the air from the air outlets 3. In the casing 1, a heat exchanger 7, which is, for example, of a fin-and-tube type, is also provided to surround the fan 6. The heat exchanger 7 causes heat exchange to be performed between refrigerant that flows in the heat exchanger 7 and air in the air-conditioned space that is sucked into the casing 1 by the fan 6. Below the heat exchanger 7, a drain pan 8 that receives condensed water discharged from the heat exchanger 7 is provided.

The heat exchanger 7 is located outward of the air inlet 2 and inward of the air outlets 3, as viewed in plan view. Specifically, the casing 1 includes a suction air trunk 4 through which the air inlet 2 and the heat exchanger 7 communicate with each other, and blowout flow passages 5 through which the heat exchanger 7 and the air outlets 3 are communicated with each other. In other words, the suction air trunk 4 is an air passage connected to the air inlet 2 and configured to guide air in the air-conditioned space sucked from the air inlet 2 to the heat exchanger 7. The blowout flow passages 5 are air trunks connected to the air outlets 3 and configured to guide conditioned air subjected to heat exchange at the heat exchanger 7 to the air outlets 3. Thus, the fan 6 is rotated to cause air in the air-conditioned space to be sucked into the casing 1 from the air inlet 2 and to flow into the heat exchanger 7 through the suction air trunk 4, as suction air 101 and blowout air 102 shown by arrows in FIG. 2. Also, the air in the air-conditioned space that has flowed into the heat exchanger 7 exchanges heat with refrigerant that flows through a refrigerant flow passage in the heat exchanger 7, and is provided as conditioned air. The conditioned air passes through the blowout flow passages 5, and is blown from the air outlets 3 to the air-conditioned space.

In Embodiment 1, since the number of the air outlets 3 is four, the number of the blowout flow passages 5 is also four. Each blowout flow passage 5, substantially as well as each air outlet 3, has a substantially rectangular cross section perpendicular to a flow direction of air in the blowout flow passage 5.

In the indoor unit 100 according to Embodiment 1, in each of the blowout flow passages 5, a vertical airflow adjusting vane 50 and lateral airflow adjusting vanes 40 are provided to adjust an angle of conditioned air that is blown from an associated one of the air outlets 3.

The vertical airflow adjusting vane 50 adjusts in a vertical direction, the angle of the conditioned air that is blown from the associated air outlet 3. The vertical airflow adjusting vane 50 is a plate-like part extending in the longitudinal direction of the blowout flow passage 5. The vertical airflow adjusting vane 50 is swung in the vertical direction around its rotation axis extending in the longitudinal direction of the blowout flow passage 5. This swinging operation of the vertical airflow adjusting vane 50 in the vertical direction can be performed by a drive motor (not shown). Thus, as an outer peripheral end of the vertical airflow adjusting vane 50 moves more upwards, the angle between a direction in which the conditioned air is blown from the air outlet 3 and a horizontal direction decreases. Furthermore, as the outer peripheral end of the vertical airflow adjusting vane 50 moves more downwards, the conditioned air is blown more downwards from the air outlet 3.

The lateral airflow adjusting vanes 40 adjust the angle in the lateral direction of the conditioned air that is blown from the associated air outlet 3. The lateral airflow adjusting vanes 40 are provided in each air outlet 3. The lateral airflow adjusting vanes 40 will be described later in detail.

The casing 1 according to Embodiment 1 includes a body unit 10, a lateral airflow dividing unit 20, and a design panel 30.

The body unit 10 is, for example, a box formed in the shape of a substantially rectangular cuboid. The body unit 10 houses the fan 6, the heat exchanger 7, and the drain pan 8. In the body unit 10, a first suction air trunk 14 and first blowout flow passages 15 are provided. The first suction air trunk 14 forms part of the suction air trunk 4, and the first blowout flow passages 15 form part of the respective blowout flow passages 5. An end of the first suction flow passage 14 that is located opposite to the heat exchanger 7 is open, for example, in a substantially center portion of a lower surface portion of the body unit 10. Ends of the first blowout flow passages 15 that are located opposite to the heat exchanger 7 are open in the lower surface portion of the body unit 10 such that the ends of the first blowout flow passages 15 surround four sides of an opening port of the first suction flow passage 14.

The lateral airflow dividing unit 20 is attached to a lower portion of the body unit 10. The lateral airflow dividing unit 20 has substantially the same shape as the body unit 10 as viewed in plan view. Specifically, the lateral airflow dividing unit 20 is formed in a substantially quadrangle shape as viewed in plan view. In the lateral airflow dividing unit 20, a second suction flow passage 24 and second blowout flow passages 25 are formed. The second suction flow passage 24 forms part of the suction flow passage 4 and is communicated with the first suction flow passage 14. The second suction flow passage 24 is a through hole formed in a substantially center portion of the lateral airflow dividing unit 20 as viewed in plan view. The second blowout flow passages 25 form part of the blowout flow passages 5 and communicate with the first blowout flow passages 15. The second blowout flow passages 25 are through holes arranged so as to surround four sides of the second suction flow passage 24 as viewed in plan view. In Embodiment 1, the lateral airflow adjusting vanes 40 are provided in the second suction flow passage 24 of the lateral airflow dividing unit 20.

The design panel 30 is attached to a lower portion of the lateral airflow dividing unit 20, and is, for example, a plate having a substantially quadrangle shape. To be more specific, the design panel 30 forms the lower surface portion of the casing 1. The design panel 30 includes the air inlet 2, a third suction flow passage 34, third blowout flow passages 35, and the air outlets 3. The third suction flow passage 34 forms part of the suction flow passage 4 and is communicated with the second suction flow passage 24 and the air inlet 2. The third suction flow passage 34 is a through hole formed in a substantially center portion of the design panel 30 as viewed in plan view.

The third blowout flow passages 35 form part of the blowout flow passages 5 and communicate with the second blowout flow passages 25 and the air outlets 3. The third blowout flow passages 35 are through holes arranged in such a manner as to surround four sides of the third suction flow passage 34 as viewed in plan view. In Embodiment 1, the vertical airflow adjusting vane 50 are provided in the third blowout flow passages 35.

Next, the shape of each second blowout flow passage 25 will be described in detail.

Figure 3:
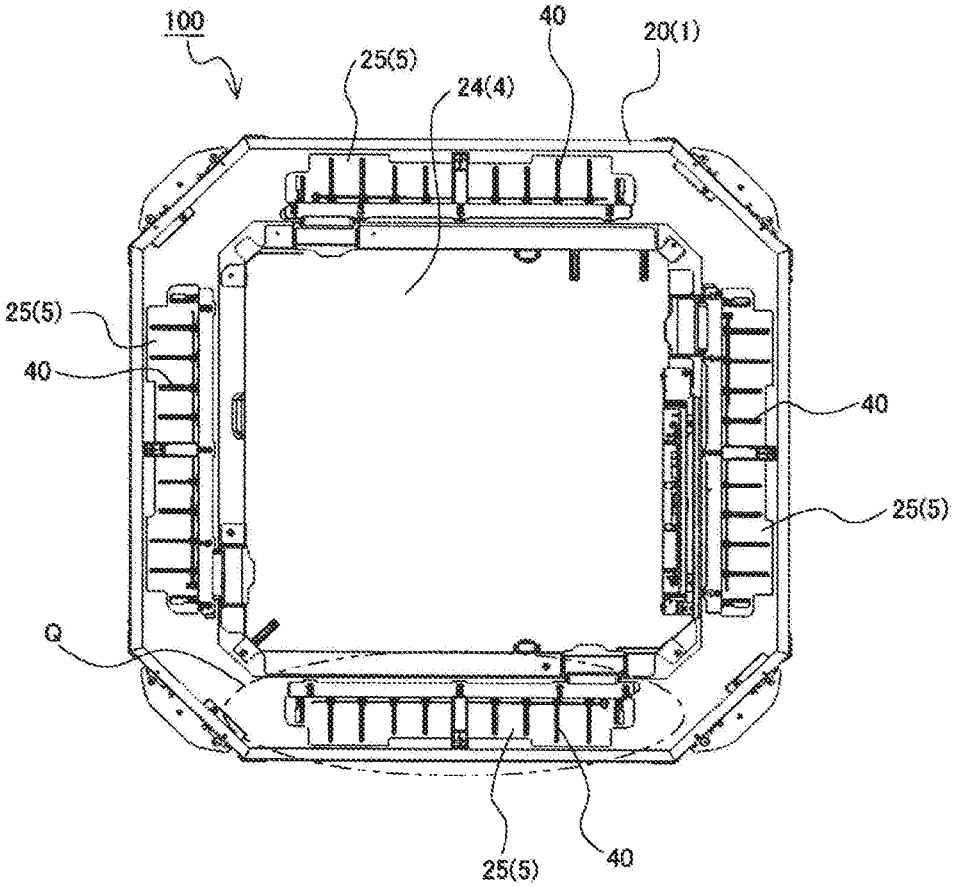
FIG. 3 is a bottom view illustrating the indoor unit of an air-conditioning apparatus according to Embodiment 1 of the present disclosure, with a design panel being removed.
Figure 4:
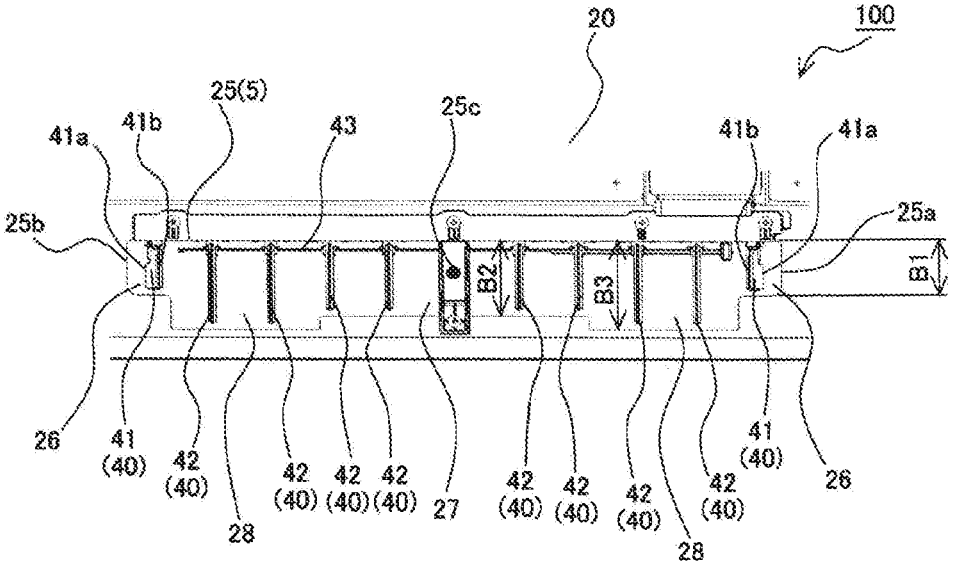
FIG. 4 is an enlarged view of part Q in FIG. 3.

FIG. 3 is a bottom view illustrating the indoor unit of an air-conditioning apparatus according to Embodiment 1 of the present disclosure, with the design panel being removed, FIG. 4 is an enlarged view of part Q in FIG. 3. Specifically, FIGS. 3 and 4 illustrate the second blowout flow passages 25 in a cross section perpendicular to a flow direction of air in the second blowout flow passages 25.

The second blowout flow passage 25 according to Embodiment 1 has a substantially rectangular cross section perpendicular to the flow direction of air in the second blowout flow passage 25, and has varying widths in the longitudinal direction. It should be noted that the width of the second blowout flow passage 25 is a length of the second blowout flow passage 25 in a direction perpendicular to the longitudinal direction in the cross section perpendicular to the flow direction of air in the second blowout flow passage 25. For example, in FIG. 4 illustrating the second blowout flow passage 25 with the longitudinal direction in a lateral direction of the drawing, the width of the second blowout flow passage 25 is the length of the second blowout flow passage 25 in a vertical direction of the drawing.

For describing the detailed shape of the second blowout flow passage 25 in the cross section perpendicular to the flow direction of air in the second blowout flow passage 25, the following definitions are provided.

The second blowout flow passage 25 has a first end 25*a* and a second end 25*b* in the longitudinal direction. In the second blowout flow passage 25, a region including the first end 25*a* is defined as a first region 26. In the second blowout flow passage 25, a region including the second end 25*b* is also defined as the first region 26. In the second blowout flow passage 25, a region including a center position 25*c* in the longitudinal direction of the second blowout flow passage 25 is defined as a second region 27. In the second blowout flow passage 25, a region between the first region 26 and the second region 27 in the longitudinal direction is defined as a third region 28. A width of the first region 26 is defined as a first width B1. A width of the second region 27 is defined as a second width B2. A width of the third region 28 is defined as a third width B3.

With such definitions, the second width B2 of the second region 27 is larger than the first width B1 of the first region 26 and smaller than the third width B3 of the third region 28. Specifically, the first width B1 of the first region 26 is smaller than the second width B2 of the second region 27 and the third width B3 of the third region 28. The third width B3 of the third region 28 is larger than the first width B1 of the first region 26 and the second width B2 of the second region 27.

As described above, the lateral airflow adjusting vanes 40 are provided in the second blowout flow passage 25. The lateral airflow adjusting vanes 40 according to Embodiment 1 include first vanes 41 provided in the first regions 26. The first vanes 41 are provided in both the first region 26 including the first end 25*a* and the first region 26 including the second end 25*b*. The first vanes 41 are arranged to curve air flowing in the second blowout flow passage 25 toward the center position 25*c*. To be more specific, each first vane 41 has an upstream end 41*a* and a downstream end 41*b*. The upstream end 41*a* is located upstream of the downstream end 41*b* in the flow direction of air in the second blowout flow passage 25. The downstream end 41*b* is located downstream of the upstream end 41*a* in the flow direction of air in the second blowout flow passage 25. The first vane 41 in the first region 26 including the first end 25*a* has the upstream end 41*a* located closer to the first end 25*a* than the downstream end 41*b*, The first vane 41 in the first region 26 including the second end 25*b* has the upstream end 41*a* located closer to the second end 25*b* than the downstream end 41*b*. The first vanes 41 are not swung during an operation of the indoor unit 100. For example, the first vanes 41 are secured to the second blowout flow passage 25.

The lateral airflow adjusting vanes 40 according to Embodiment 1 further include a plurality of second vanes 42 in the second region 27 and the third region. The plurality of second vanes 42 are arranged at predetermined intervals in the longitudinal direction of the second blowout flow passage 25. The respective second vanes 42 are attached to the second blowout flow passage 25 so that they can rotate. The second vanes 42 are coupled to each other by a coupling part 43. The coupling part 43 is also coupled to a drive motor (not shown). Thus, the drive motor causes the coupling part 43 to reciprocate in the longitudinal direction of the second blowout flow passage 25, thereby causing, for example, downstream ends of the respective second vanes 42 to be swung in the longitudinal direction of the second blowout flow passage 25.

Specifically, the plurality of second vanes 42 can be swung in the longitudinal direction of the second blowout flow passage 25 during the operation of the indoor unit 100. The air flowing in the second blowout flow passage 25 is curved in a direction in which the downstream ends of the second vanes 42 are moved. In other words, the air is curved and blown from the air outlet 3 in the direction in which the downstream ends of the second vanes 42 are moved.

Next, the operation of the indoor unit 100 according to Embodiment 1 will be described.

As the suction air 101 shown by arrows in FIG. 2, when the fan 6 is rotated, air in the air-conditioned space is sucked from the air inlet 2 into the casing 1 and flows into the heat exchanger 7 through the suction flow passage 4. When passing through the heat exchanger 7, the air that has flowed into the heat exchanger 7 exchanges heat with the refrigerant that flows through the refrigerant flow passage in the heat exchanger 7 and is thus conditioned. Then, as the blowout air 102 shown by arrows in FIG. 2, the conditioned air passes through the blowout flow passages 5, and is blown into the air-conditioned space from the air outlets 3. In this case, air in the second blowout flow passages 25 is blown from the second blowout flow passages 25 as described below. Specifically, a flow of air in the second blowout flow passages 25 is blown from the air outlets 3 as described below.

Figure 5:
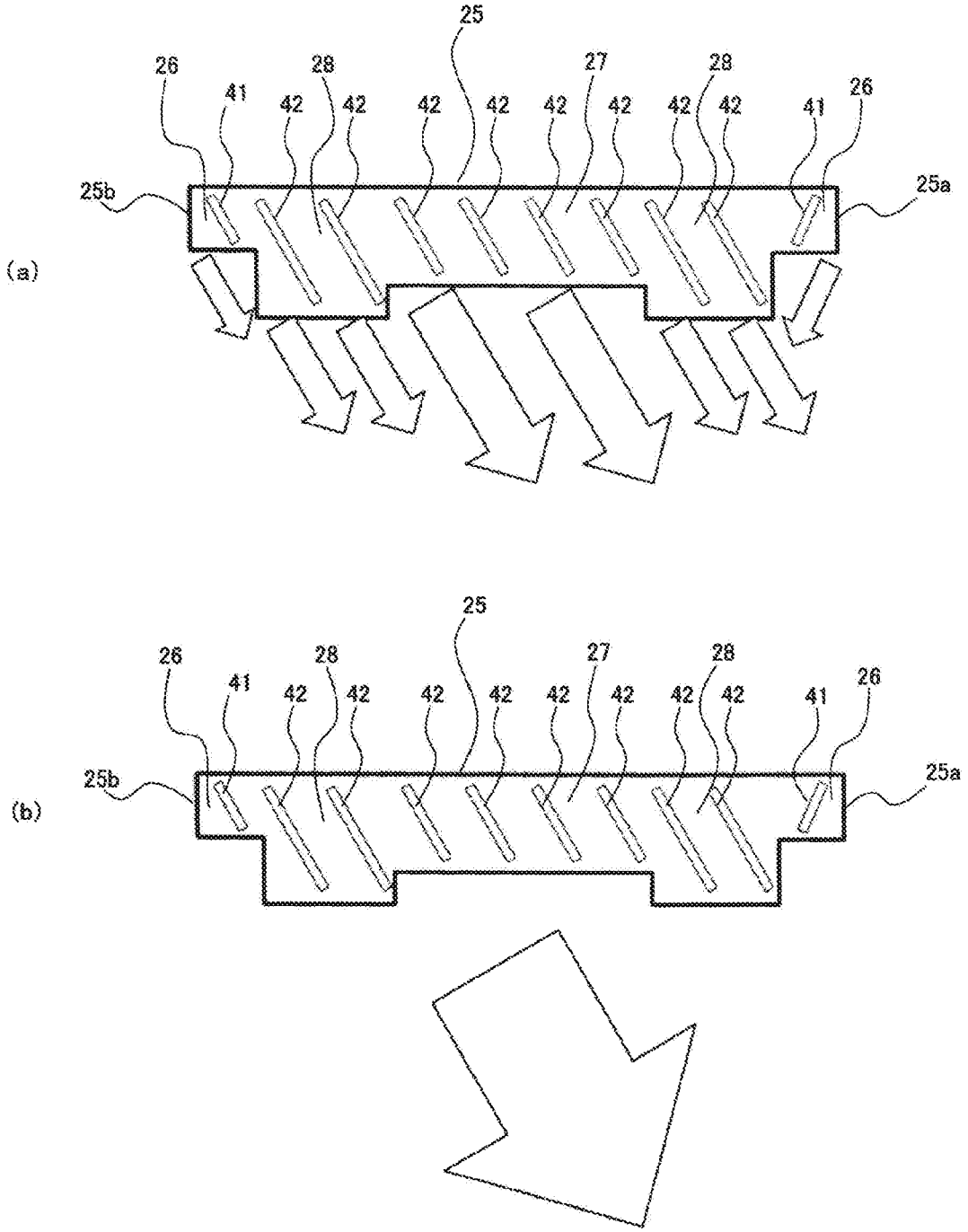
FIG. 5 is a conceptual view illustrating a flow of air blown from a second blowout flow passage according to Embodiment 1 of the present disclosure.

FIG. 5 is a conceptual view illustrating a flow of air blown from the second blowout flow passage according to Embodiment 1 of the present disclosure. In FIG. 5, the second blowout flow passage 25 is shown in the cross section perpendicular to the flow direction of air in the second blowout flow passage 25. Also, for each of the lateral airflow adjusting vanes 40 in FIG. 5, an upper side of the drawing is an upstream end in the flow direction of air, and a lower side of the drawing is a downstream end in the flow direction of air. Solid-white arrows in FIG. 5(*a*) show directions of flows of air blown from the respective regions of the second blowout flow passage 25. A solid-white arrow in FIG. 5(*b*) shows the flows of air in FIG. 5(*a*) joined together, which is an overall flow of air blown from the second blowout flow passage 25. In FIG. 5, longer solid-white arrows show faster flows of air.

In the second blowout flow passage 25 according to Embodiment 1, the first width B1 of the first region 26 is smaller than the second width B2 of the second region 27 and the third width B3 of the third region 28. Thus, the second blowout flow passage 25 according to Embodiment 1 can increase the speed of air blown from the first regions 26 around the ends in the longitudinal direction of the second blowout flow passage 25. Specifically, in the indoor unit 100 according to Embodiment 1, an air flow speed around the ends in the longitudinal direction of the air outlet 3 increases, thereby providing uniform speed distribution of air blown from the air outlet 3 as before.

Further, in the second blowout flow passage 25 according to Embodiment 1, the second width B2 of the second region 27 that is the region including the center position 25*c* is smaller than the third width B3 of the third region 28. Thus, the indoor unit 100 according to Embodiment 1 can increase an air flow speed at the second region 27 as compared with an existing indoor unit that provides uniform speed distribution of air blown from an air outlet. Specifically, the indoor unit 100 according to Embodiment 1 can increase an air flow speed at the center position in the longitudinal direction of the air outlet 3 as compared with the existing indoor unit that provides uniform speed distribution of air blown from an air outlet. By increasing the air flow speed at the center position in the longitudinal direction of the air outlet 3, a flow of air blown from the air outlet 3 through the third region 28 of the second blowout flow passage 25 is caught by a flow of air blown from the center position in the longitudinal direction of the air outlet 3 and increased in speed. Thus, the second blowout flow passage 25 according to Embodiment 1 can increase a reach distance of air blown from the air outlet 3 as compared with the existing indoor unit that provides uniform speed distribution of air blown from an air outlet.

If the air flow speed around the ends in the longitudinal direction of the air outlet 3 is increased to above a certain speed, air blown from around the ends in the longitudinal direction of the air outlet 3 may flow around an outer periphery of the air outlet 3. If the air flows around the outer periphery of the air outlet 3 in this manner during a cooling operation, the air that has flowed around the outer periphery may collide with areas on the casing 1, which are cooled to cause condensation. However, the indoor unit 100 according to Embodiment 1 includes, in the first regions 26 of the second blowout flow passage 25, the first vanes 41 that curve the air flowing in the second blowout flow passage 25 toward the center position 25*c*. Thus, the indoor unit 100 according to Embodiment 1 can prevent the air blown from around the ends in the longitudinal direction of the air outlet 3 from flowing around the outer periphery of the air outlet 3, and prevent the air flowing around the outer periphery of the air outlet 3 from causing condensation.

The indoor unit 100 according to Embodiment 1 includes, in the second region 27 and the third regions, the plurality of second vanes 42 that are swingable in the longitudinal direction of the second blowout flow passage 25 during the operation of the indoor unit 100. With such a plurality of second vanes 42, the air flow curved by the plurality of second vanes 42 may collide with the ends and the vicinity thereof in the longitudinal direction of the air outlet 3. During the cooling operation, if the air flow curved by the plurality of second vanes 42 collides with the ends and the vicinity thereof in the longitudinal direction of the air outlet 3, the ends and the vicinity thereof in the longitudinal direction of the air outlet 3 may be cooled to cause condensation. However, the indoor unit 100 according to Embodiment 1 includes, in the first regions 26 of the second blowout flow passage 25, the first vanes 41 that curve the air flowing in the second blowout flow passage 25 toward the center position 25*c*. Thus, in the indoor unit 100 according to Embodiment 1, the air flow curved toward the center position 25*c* by the first vanes 41 can prevent the air flow curved by the plurality of second vanes 42 from colliding with the ends and the vicinity thereof in the longitudinal direction of the air outlet 3. Thus, the indoor unit 100 according to Embodiment 1 can prevent condensation caused by the air flow curved by the plurality of second vanes 42 colliding with the ends and the vicinity thereof in the longitudinal direction of the air outlet 3.

In the indoor unit 100 according to Embodiment 1, the third blowout flow passage 35 downstream of the second blowout flow passage 25 in the flow direction of air in the blowout flow passage 5 has a rectangular cross section perpendicular to the flow direction of air in the third blowout flow passage 35. This is because the third blowout flow passage 35 is short in the flow direction of air, and the air flow speed having been increased in the first regions 26 and the second region 27 of the second blowout flow passage 25 is hardly decreased in the third blowout flow passage 35. However, it is needless to say that the shape of the cross section of the third blowout flow passage 35 perpendicular to the flow direction of air in the third blowout flow passage 35 may be the same as that of the second blowout flow passage 25. In other words, when a place where the second width B2 of the second region 27 is larger than the first width B1 of the first region 26 and smaller than the third width B3 of the third region 28 is defined as a first place, the third blowout flow passage 35 as well as the second blowout flow passage 25 may have the first place. Of course, the first blowout flow passage 15 and the third blowout flow passage 35 as well as the second blowout flow passage 25 may have the first place. Specifically, as long as the first place is provided at least in a partial area of the blowout flow passage 5, the above described advantage can be obtained resulting from the fact that the second width B2 of the second region 27 is larger than the first width B1 of the first region 26 and smaller than the third width B3 of the third region 28.

Also, the indoor unit 100 according to Embodiment 1 is concealed in or suspended from a ceiling located above an air-conditioned space such as a room. However, the indoor unit 100 according to Embodiment 1 is not limited to the indoor unit with such an installation mode. For example, the indoor unit 100 according to Embodiment 1 may be a wall-mounted indoor unit provided on a wall of an air-conditioned space. In this case, the above described advantage can be obtained as long as the first place as described above is provided at least in a partial area of a blowout flow passage.

Further, the configuration of the plurality of second vanes 42 that are swingable in the longitudinal direction of the second blowout flow passage 25 during the operation of the indoor unit 100 is not limited to the above described configuration. Among existing indoor units having a plurality of vanes that are swingable in a longitudinal direction of a blowout flow passage, an indoor unit is known having a configuration in which a plurality of vanes are divided into two groups at a predetermined position in the longitudinal direction of the blowout flow passage and each group of the vanes is independently swingable during an operation of the indoor unit. The plurality of second vanes 42 in the indoor unit 100 according to Embodiment 1 may be configured in this manner, for example. An example of the indoor unit 100 with such a configuration of the second vanes 42 is illustrated in FIG. 6.

Figure 6:
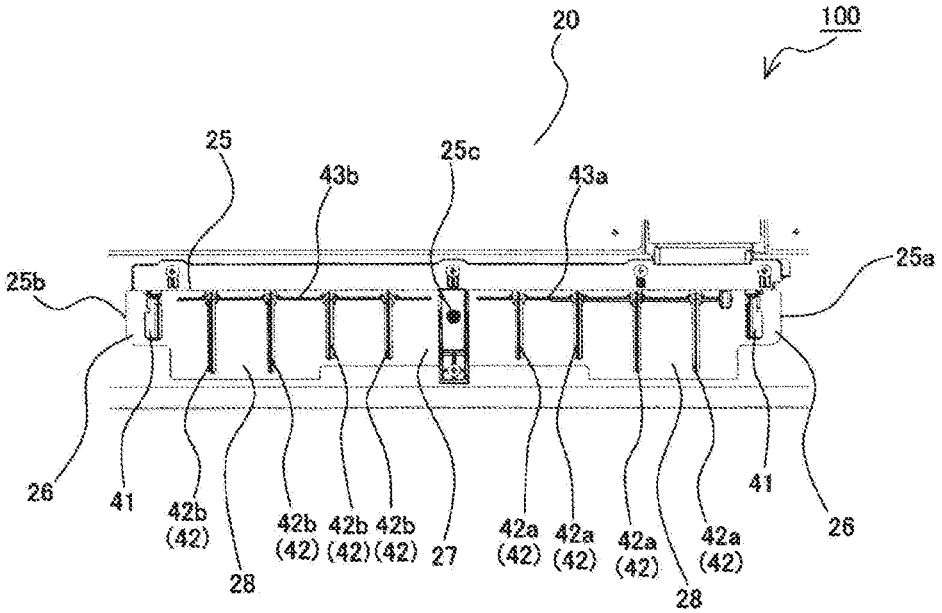
FIG. 6 illustrates a second blowout flow passage and the vicinity thereof in another example of the indoor unit of an air-conditioning apparatus according to Embodiment 1 of the present disclosure.

FIG. 6 illustrates a second blowout flow passage and the vicinity thereof in another example of the indoor unit of an air-conditioning apparatus according to Embodiment 1 of the present disclosure. FIG. 6 shows the lateral airflow dividing unit 20 viewed from below, with the design panel 30 being removed. In other words, FIG. 6 shows a second blowout flow passage 25 and the vicinity thereof in another example of the indoor unit 100 as viewed in the same direction as in FIG. 4. Specifically, FIG. 6 shows the second blowout flow passage 25 and the vicinity thereof in another example of the indoor unit 100 in a cross section perpendicular to the flow direction of air in the second blowout flow passage 25.

The plurality of second vanes 42 in FIG. 6 are divided into two groups at the center position 25*c* as an example of a predetermined position. Hereafter, the second vanes 42 arranged closer to the first end 25*a* than the center position 25*c* are defined as first end side second vanes 42*a*. The second vanes 42 arranged closer to the second end 25*b* than the center position 25*c* are defined as second end side second vanes 42*b*. Depending on a predetermined position dividing the first end side second vanes 42*a* from the second end side second vanes 42*b*, the number of the first end side second vanes 42*a* or the second end side second vanes 42*b* may be one.

The first end side second vanes 42*a* are coupled to each other by a first coupling part 43*a*. The first coupling part 43*a* is also coupled to a drive motor (not shown). Thus, the drive motor causes the first coupling part 43*a* to reciprocate in the longitudinal direction of the second blowout flow passage 25, thereby causing, for example, downstream ends of the respective first end side second vanes 42*a* to be swung in the longitudinal direction of the second blowout flow passage 25. The second end side second vanes 42*b* are coupled to each other by a second coupling part 43*b*. The second coupling part 43*b* is also coupled to a drive motor (not shown). Thus, the drive motor causes the second coupling part 43*b* to reciprocate in the longitudinal direction of the second blowout flow passage 25, thereby causing, for example, downstream ends of the respective second end side second vanes 42*b* to be swung in the longitudinal direction of the second blowout flow passage 25.

With such a configuration of the plurality of second vanes 42, during the operation of the indoor unit 100, the plurality of first end side second vanes 42*a* can be swung independently of the plurality of second end side second vanes 42*b*. To be more specific, during the operation of the indoor unit 100, the plurality of first end side second vanes 42*a* can be inclined in a different manner from the plurality of second end side second vanes 42*b*.

As described above, the indoor unit 100 of an air-conditioning apparatus according to Embodiment 1 includes the air outlets 3, and the blowout flow passages 5 connected to the air outlets 3 and configured to guide air subjected to heat exchange at the heat exchanger 7 to the air outlets 3. In the indoor unit 100 of an air-conditioning apparatus according to Embodiment 1, the second width B2 of the second region 27 is larger than the first width B1 of the first region 26 and smaller than the third width B3 of the third region 28 at least in a partial area of each blowout flow passage 5. Thus, as described above, the indoor unit 100 of an air-conditioning apparatus according to Embodiment 1 can provide uniform speed distribution of air blown from the air outlets 3 as before. Further, as described above, the indoor unit 100 of an air-conditioning apparatus according to Embodiment 1 can increase a reach of air blown from the air outlets 3 as compared with an existing indoor unit that provides uniform speed distribution of air blown from an air outlet.

Embodiment 2

Regarding Embodiment 2, an example of an air-conditioning apparatus including the indoor unit 100 according to Embodiment 1 will be described. It should be noted that, in Embodiment 2, matters not described regarding Embodiment 2 and described regarding Embodiment 1 are the same as those described in Embodiment 1, and in the descriptions regarding Embodiment 2, functions and components that are the same as in Embodiment 1 will be denoted by the same reference signs.

Figure 7:
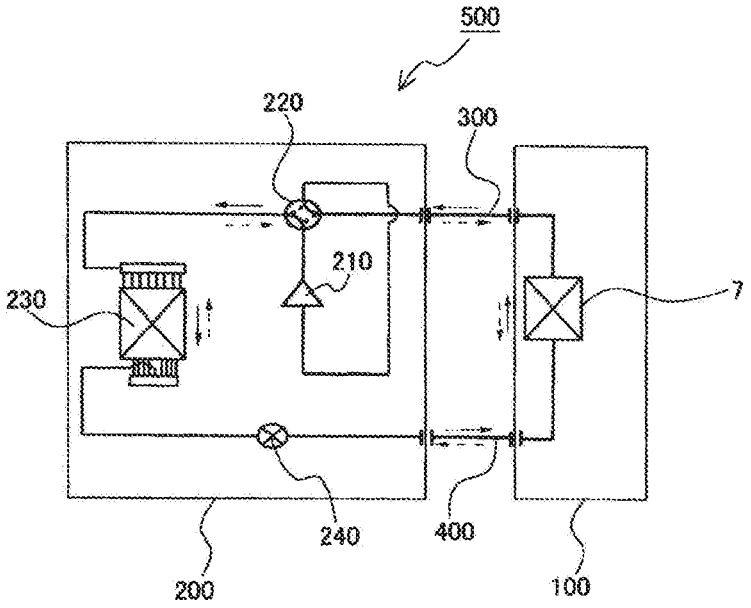
FIG. 7 is an example of a refrigerant circuit diagram illustrating an air-conditioning apparatus according to Embodiment 2 of the present disclosure.

FIG. 7 is a refrigerant circuit diagram illustrating an example of an air-conditioning apparatus according to Embodiment 2 of the present disclosure. Solid arrows in FIG. 7 show a flow direction of refrigerant during a cooling operation. Dashed arrows in FIG. 7 show a flow direction of refrigerant during a heating operation.

An air-conditioning apparatus 500 according to Embodiment 2 includes the indoor unit 100 in Embodiment 1 and an outdoor unit 200. The indoor unit 100 and the outdoor unit 200 are connected by a gas refrigerant pipe 300 and a liquid refrigerant pipe 400. The indoor unit 100 includes a heat exchanger 7 as an indoor heat exchanger. The outdoor unit 200 includes a compressor 210, a four-way valve 220, an outdoor heat exchanger 230, and an expansion valve 240.

The compressor 210 compresses suctioned refrigerant and discharges the compressed refrigerant. Although not particularly limited, a capacity of the compressor 210 may be changed, for example, by arbitrarily changing an operation frequency using an inverter circuit. It should be noted that the capacity of the compressor 210 represents an amount of refrigerant fed per unit time. The four-way valve 220 is, for example, a valve that switches a flow of the refrigerant between the cooling operation and the heating operation.

The outdoor heat exchanger 230 causes heat exchange to be performed between the refrigerant and outdoor air. The outdoor heat exchanger 230 functions as an evaporator during the heating operation, and evaporates the refrigerant. The outdoor heat exchanger 230 functions as a condenser during the cooling operation, and condenses and liquefies the refrigerant.

The expansion valve 240 is, for example, a throttling device, and reduces pressure of the refrigerant and expands the refrigerant. For example, when the expansion valve 240 is an electronic expansion valve, an opening degree of the expansion valve 240 is adjusted based on an instruction from a controller (not shown). The heat exchanger 7 as the indoor heat exchanger exchanges heat between air in the air-conditioned space and the refrigerant. The heat exchanger 7 functions as a condenser during the heating operation, and condenses and liquefies the refrigerant. The heat exchanger 7 functions as an evaporator during the cooling operation, and evaporates the refrigerant.

With such a configuration of the air-conditioning apparatus 500, the four-way valve 220 of the outdoor unit 200 can switch the flow of the refrigerant, thereby achieving the heating operation and the cooling operation.

REFERENCE SIGNS LIST

| | | | |
|---|---|---|---|
| 1 casing, | 2 air inlet, | 3 air outlet, | 4 suction flow passage, |
| 5 blowout flow passage, | 6 fan, | 7 heat exchanger, | 8 drain pan, |
| 9 filter, | 10 body unit, | 14 first suction flow passage, | 15 first blowout flow passage, |
| 20 lateral airflow dividing unit, | 24 second suction flow passage, | | |
| 25 second blowout flow passage, | 25a first end, | 25b second end, | 25c center position, |
| 26 first region, | 27 second region, | 28 third region, | 30 design panel, |
| 34 third suction flow passage, | 35 third blowout flow passage, | | |
| 40 lateral airflow adjusting vane, | 41 first vane, | 41a upstream end, | |
| 41b downstream end, | 42 second vane, | 42a first end side second vane, | |
| 42b second end side second vane, | 43 coupling part, | 43a first coupling part, | |
| 43b second coupling part, | 50 vertical airflow adjusting vane, | 100 indoor unit, | |
| 101 suction air, | 102 blowout air, | 200 outdoor unit, | 210 compressor, |
| 220 four-way valve, | 230 outdoor heat exchanger, | 240 expansion valve, | |
| 300 gas refrigerant pipe, | 400 liquid refrigerant pipe, | 500 air-conditioning apparatus, | |
| B1 first width, | B2 second width, | B3 third width | |

The invention claimed is:

1. An indoor unit of an air-conditioning apparatus, comprising:

an air outlet; and a blowout flow passage connected to the air outlet and configured to guide air subjected to heat exchange at a heat exchanger to the air outlet, wherein in a cross section perpendicular to a flow direction of the air in the blowout flow passage, the blowout flow passage has a first end and a second end in a longitudinal direction, the blowout flow passage is divided into first regions, a second region, and third regions, the first regions being a region including the first end and a region including the second end, the second region being a region including a center position in the longitudinal direction of the blowout flow passage, the third regions being regions between the first regions and the second region in the longitudinal direction, when a length of the blowout flow passage in a direction perpendicular to the longitudinal direction in the cross section is defined as a width, a width of each of the first regions is defined as a first width, a width of the second region is defined as a second width, and a width of each of the third regions is defined as a third width, the second width is larger than the first width and smaller than the third width at least in a partial area of the blowout flow passage, and when a place where the second width is larger than the first width and smaller than the third width in the blowout flow passage is defined as a first place, in the first place, first vanes are provided in the first regions, and the first vanes are arranged to curve the air toward the center position.

2. The indoor unit of an air-conditioning apparatus of claim 1, wherein in the first place, a plurality of second vanes are provided in the second region and the third regions, the plurality of second vanes being arranged at predetermined intervals in the longitudinal direction and swingable in the longitudinal direction during an operation of the indoor unit of an air-conditioning apparatus.

3. The indoor unit of an air-conditioning apparatus of claim 2, wherein when the second vane arranged closer to the first end than a predetermined position in the longitudinal direction among the plurality of the second vanes is defined as a first end side second vane, and the second vane arranged closer to the second end than the predetermined position among the plurality of the second vanes is defined as a second end side second vane, the first end side second vane is swingable independently of the second end side second vane.

* * * * *